US010092142B2

(12) United States Patent
Chang

(10) Patent No.: US 10,092,142 B2
(45) Date of Patent: Oct. 9, 2018

(54) FOAM SOAP DISPENSER

(71) Applicant: Guangzhou Faner Aroma Product Co., Ltd., Guangzhou (CN)

(72) Inventor: Hsu-Hui Chang, Guangzhou (CN)

(73) Assignee: GUANGZHOU FANER AROMA PRODUCT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/259,059

(22) Filed: Sep. 8, 2016

(65) Prior Publication Data

US 2018/0064294 A1 Mar. 8, 2018

(51) Int. Cl.
*A47K 5/14* (2006.01)
*A47K 5/12* (2006.01)

(52) U.S. Cl.
CPC ..... *A47K 5/14* (2013.01); *A47K 5/1211* (2013.01); *A47K 5/1217* (2013.01)

(58) Field of Classification Search
CPC ..... A47K 5/14; A47K 5/1211; A47K 5/1217
See application file for complete search history.

(56) References Cited

U.S. PATENT DOCUMENTS 4,790,454 A * 12/1988 Clark ..... A01C 23/042 222/136
2007/0000941 A1* 1/2007 Hadden ..... A47K 5/1217 222/52
2007/0194053 A1* 8/2007 Ophardt ..... A47K 5/1202 222/189.01
2008/0277421 A1* 11/2008 Zlatic ..... A47K 5/16 222/136

* cited by examiner

*Primary Examiner* — Donnell Long
(74) *Attorney, Agent, or Firm* — Leong C. Lei

(57) ABSTRACT

A foam soap dispenser includes a motor, stirring unit, pump and container, where the motor is combined with and linked to the stirring unit and pump; an output tube is configured on the front end of the stirring unit; the pump has an elastic sleeve body, first and second tubes, where the second tube is in communication with the container inside which soap liquid is filled. The motor drives the stirring unit and pump to operate simultaneously after the motor is started, an elastic sleeve body of the pump is operated by the motor to contract and expand, allowing the second tube to extract the soap liquid from the container to the pump, and the soap liquid is then delivered to the stirring unit through the first tube. Finally, the rotation of the stirring gears allows the soap liquid to become foam, which is output through the output tube.

5 Claims, 4 Drawing Sheets

FOAM SOAP DISPENSER

(a) TECHNICAL FIELD OF THE INVENTION

The present invention relates to a dispenser for outputting foam soap.

(b) DESCRIPTION OF THE PRIOR ART

The pumps of conventional foam soap dispenser are all designed as a disposable body, which is pulled in a vertical movement way by a mechanical structure, having defects of easy damage and malfunction.

SUMMARY OF THE INVENTION

To overcome the defects mentioned above, the present invention is proposed.

The main object of the present invention is to provide a foam soap dispenser, capable of being driven by batteries, and using a plurality of stirring gears to generate meticulous foam soap liquid.

To achieve the object mentioned above, the present invention proposes a foam soap dispenser, including a motor, stirring unit, pump and container, where the motor is combined with and linked to the stirring unit and pump; an output tube is configured on the front end of the stirring unit; the pump has an elastic sleeve body, first tube and second tube, where the first tube is in communication with the stirring unit, inside which a plurality of stirring gears are configured, the second tube is in communication with the container inside which soap liquid is filled. The motor drives the stirring unit and pump to operate simultaneously after the motor is started, an elastic sleeve body of the pump is operated by the motor to contract and expand, allowing the second tube to extract the soap liquid from the container to the pump, and the soap liquid is then delivered to the stirring unit through the first tube. Finally, the rotation of the stirring gears allows the soap liquid to become foam, which is output through the output tube.

DETAILED DESCRIPTION OF THE PREFERRED EMBODIMENTS

Figure 1:
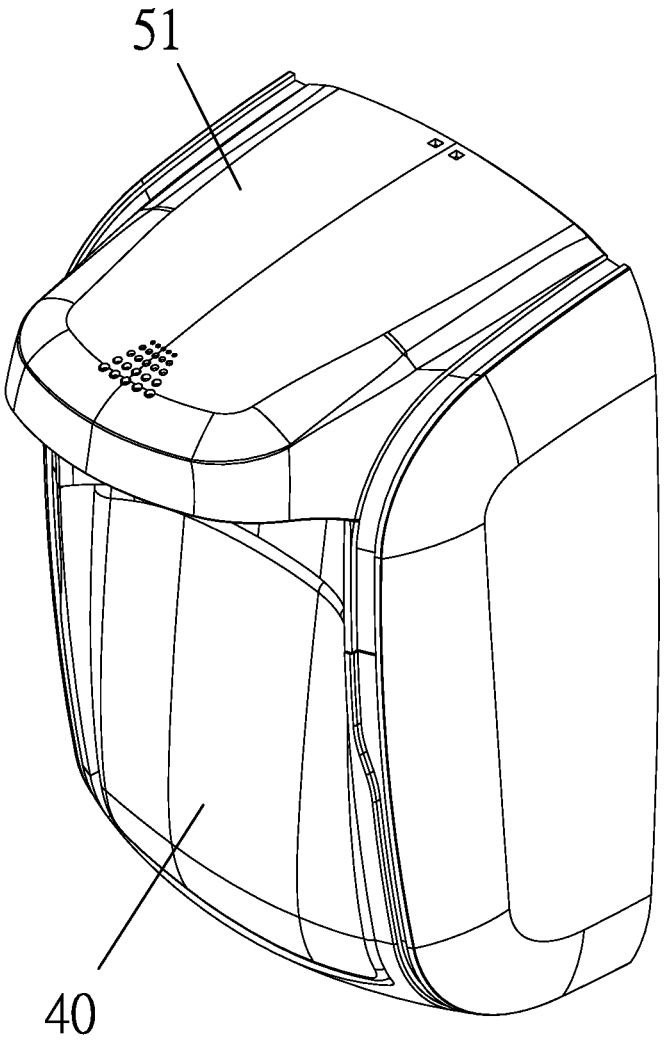
FIG. 1 is a perspective view of the present invention.
Figure 2:
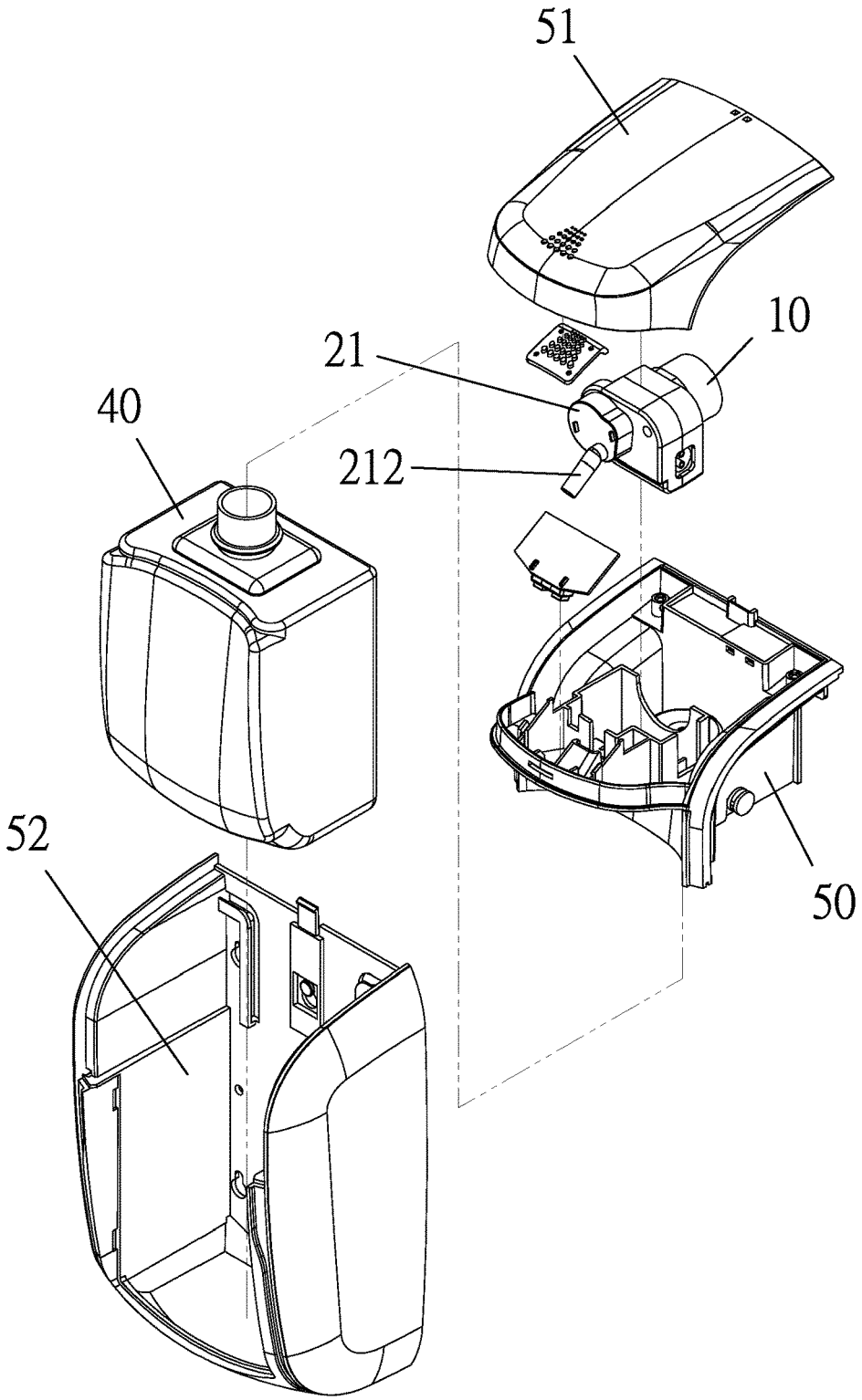
FIG. 2 is an exploded view of the present invention.

Referring to FIGS. 1 and 2, a foam soap dispenser includes a motor 10, stirring unit 20, pump 30, container 40 and seat body 50, where the motor 10, stirring unit 20 and pump 30 are installed inside the seat body 50. Furthermore, a cover 51 is covered on the top of the seat body 50, and the bottom of the seat body 50 is further configured with a third accommodation space 52 for accepting the container 40.

Figure 3:
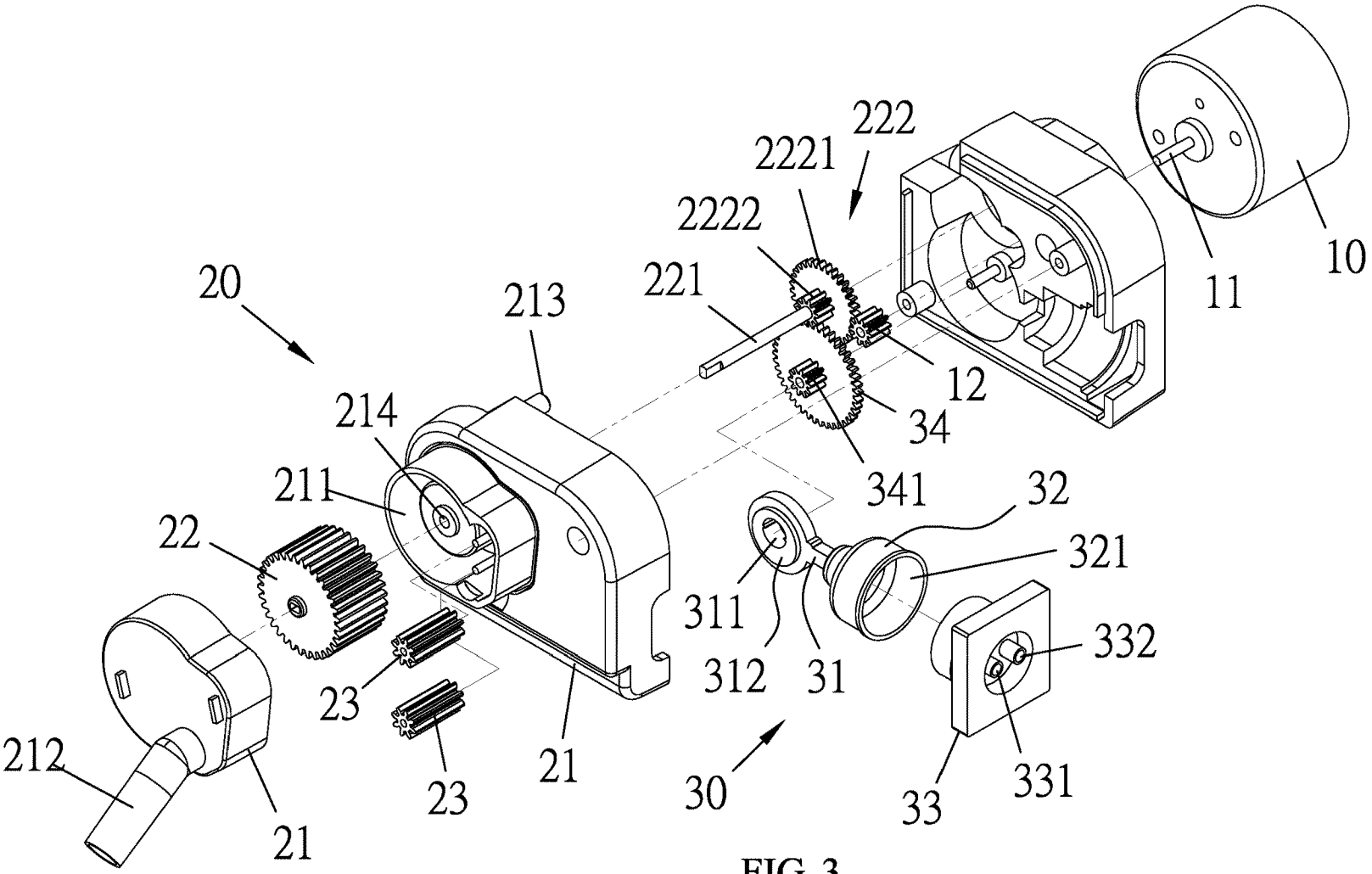
FIG. 3 is a partly exploded view of the present invention.

Referring to FIGS. 2 and 3, the motor 10 has a transmission shaft 11, on which a first gear 12 is configured, with the motor 10 being in electric connection with a sensing device (not shown in the figures).

The seat body 50 is further configured with a battery case (not shown in the figures) for the installment of batteries, being in electric connection with the motor 10.

Referring to FIG. 3, the stirring unit 20 has a housing 21, at least one transmission wheel 22 and a plurality of stirring gears 23, where a first accommodation space 211 is formed in the housing 21, the stirring gears 23 are configured in the first accommodation of the housing 21, an output tube 212 is configured on the front side of the housing 21, and an input hole 213 and through hole 214 are opened on the rear side of the housing 21. Furthermore, the transmission wheel 22 is configured with a first connecting rod 221 passed through the through hole 214, and another end of the first connecting rod 221 a first reduction gear 222 having a larger gear 2221 and small gear 2222, the large gear 2221 being engaged with the first gear 12.

Referring to FIG. 3 again, the pump 30 includes a second connecting rod 31, elastic sleeve body 32 and two-way circulation element 33, where one end of the second connecting rod 31 is configured with a second gear 34 in engagement with the small gear 2222 of the first reduction gear 222, another end of it is coupled to the elastic sleeve body 32, inside which a second accommodation space 321 is formed. Furthermore, the two-way circulation element 33 has a first tube 331 and second tube 332, one end of the two-way circulation element 33 is accepted in the second accommodation space 321, allowing one end of each of the first tube 331 and second tube 332 is positioned inside the second accommodation space 321, where another end of the first tube 331 is coupled to the input hole 213.

A pinion 341 is further configured on the center of the second gear 34, and the second connecting rod 31 is coupled to the pinion 341 of the second gear 34.

One end of the second connecting rod 31 coupled to the pinion 341 has a hollow section 311, the inner wall of which is coupled to the pinion 341. In the embodiment, an elastic element 312, which is in engagement with the pinion 341, is further coupled to the inside of the hollow section 311.

The container 40 is filled with soap liquid (not shown in the figures) inside it, and the second tube 332 is coupled to the container 40 and in contact with the soap liquid so as to carry out the extraction of the soap liquid.

Figure 4:
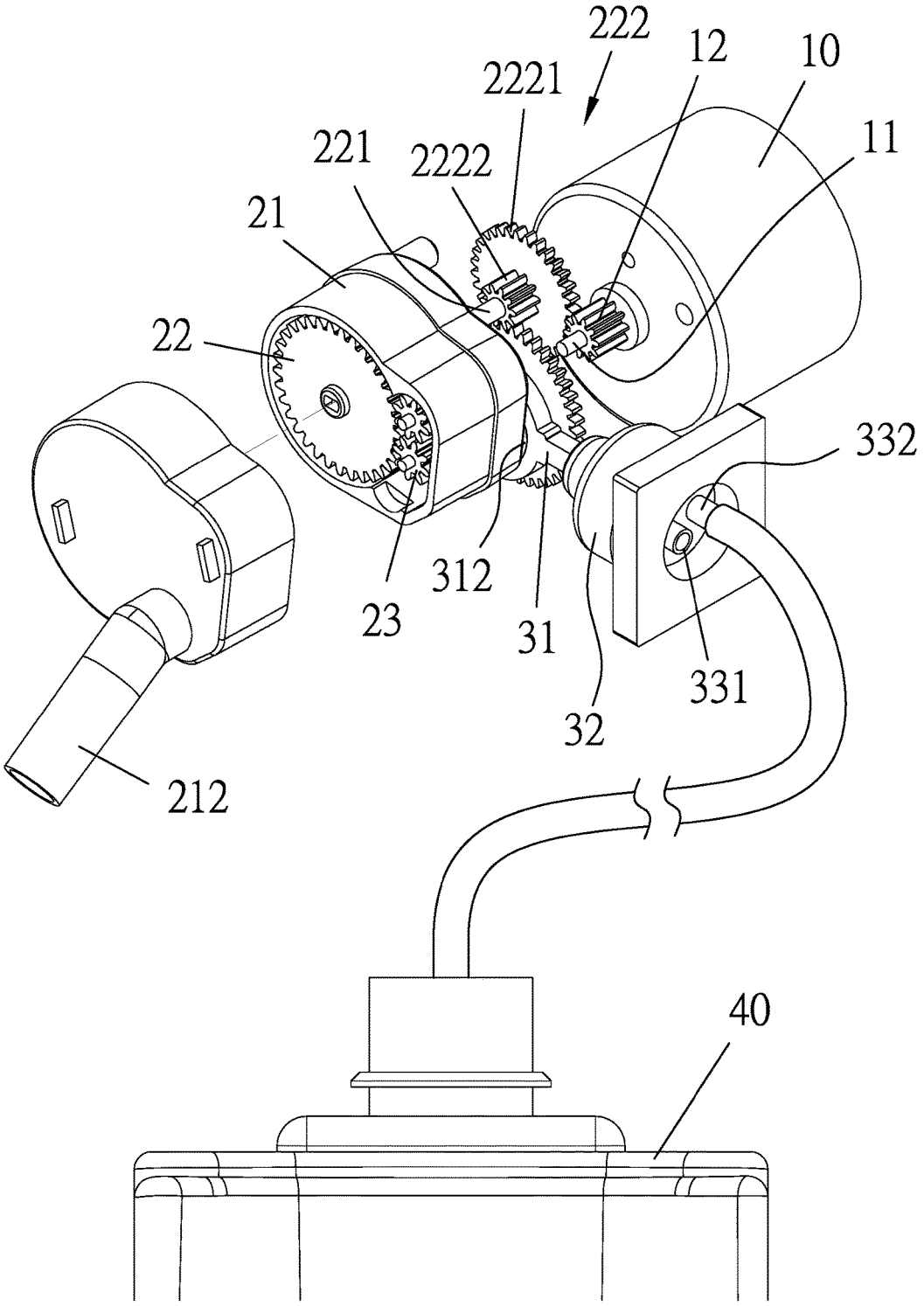
FIG. 4 shows the present invention in a use state.

Referring to FIG. 4, the sensing device, upon use, senses that a user's hand places under the output tube 212, and the motor 10 is started to run to rotate the transmission shaft 11 and first gear 12 synchronously, and at the same time, drive the first reduction gear 222 in engagement with the first gear 12 and the second gear 34 in engagement with the small gear 2222 of the first reduction gear 222. Subsequently, the elastic sleeve body 32 is subject to the back and forth movement of the second connecting rod 31 to extract and expand to generate attraction force when the second gear 34 is rotated because the pinion 341 of the second gear 34 is in combination with the second connecting rod 31 and the elastic sleeve body 32 is an elastic body, enabling the second tube 332 to extract the soap liquid and deliver it to the elastic sleeve body 32. Thereafter, the soap liquid is delivered into the stirring unit 20 through the first tube 331 and input hole 213 by means of the expansion force.

Finally, the first reduction gear 222 drives the transmission wheel 22 through the first connecting rod 221, and the transmission wheel 22 further drives the stirring gears 23 to stir the soap liquid input from the input hole 213, allowing the soap liquid to generate meticulous foam, which is then output to the use's hand through the output tube 212.

I claim:

1. A foam soap dispenser, comprising:

a motor, having a transmission shaft, said transmission shaft being configured with a first gear, and said motor being in electric connection with a sensing device;

a stirring unit, having a housing, at least one transmission wheel and a plurality of stirring gears, a first accommodation space being formed inside said housing, said stirring gears being configured inside said housing, an output tube on a front side of said housing, an input hole and a through hole on a rear side of said housing, said at least one transmission wheel being provided with a first connecting rod passing through said through hole, a first reduction gear on an end of said first connecting rod, said first reduction gear having a large gear and small gear, and said large gear being in engagement with said first gear;

a pump, having a second connecting rod, elastic sleeve body and two-way circulation element, a second gear being configured on one end of said second connecting rod, said second gear being in engagement with said small gear of said first reduction gear, another end of said second connecting rod being engaged with said elastic sleeve body, a second accommodation space being formed inside said elastic sleeve body, said two-way circulation element having a first tube and second tube, one end of said two-way circulation element being configured inside said second accommodation space, allowing one end of each of said first tube and second tube being positioned inside said second accommodation space, and another end of said first tube being engaged with said input hole; and a container, an inside thereof being filled with soap liquid, and said second tube being engaged with said container and in contact with said soap liquid.

2. The dispenser according to claim 1, wherein a pinion is further configured on a center of said second gear, and said second connecting rod is engaged with said pinion of said second gear.

3. The dispenser according to claim 2, wherein one end of said second connecting rod engaged with said pinion has a hollow section, an inner wall of said hollow section is engaged with said pinion.

4. The dispenser according to claim 3, wherein an elastic element is further engaged with an inside of said hollow section, said elastic element is in engagement with said pinion.

5. The dispenser according to claim 1, wherein said motor, stirring unit and pump are configured inside a seat body, a cover is covered on a top face of said seat body, a third accommodation space is formed on a bottom of said seat body, and said container is configured inside said third accommodation space.

* * * * *